US012227822B2

(12) United States Patent
Bordignon et al.

(10) Patent No.: US 12,227,822 B2
(45) **Date of Patent: *Feb. 18, 2025**

(54) HOT-DIP COATED STEEL SUBSTRATE

(71) Applicant: ArcelorMittal, Luxembourg (LU)

(72) Inventors: Michel Bordignon, Sprimont (BE); Jonas Staudte, Montigny-les-Metz (FR)

(73) Assignee: ArcelorMittal, Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 18/142,197

(22) Filed: May 2, 2023

(65) Prior Publication Data

US 2023/0272516 A1 Aug. 31, 2023

Related U.S. Application Data

(63) Continuation of application No. 16/769,912, filed as application No. PCT/IB2018/058185 on Oct. 22, 2018, now Pat. No. 11,674,209.

(30) Foreign Application Priority Data

Oct. 22, 2018 (WO) ..... PCT/IB2018/058185

(51) Int. Cl.

| | |
|---|---|
| ***C22C 38/02*** | (2006.01) |
| ***C21D 1/26*** | (2006.01) |
| ***C22C 38/04*** | (2006.01) |
| ***C22C 38/06*** | (2006.01) |
| ***C23C 2/02*** | (2006.01) |
| ***C23C 2/06*** | (2006.01) |
| ***C25D 3/30*** | (2006.01) |

(52) U.S. Cl.

CPC ..... *C22C 38/02* (2013.01); *C21D 1/26* (2013.01); *C22C 38/04* (2013.01); *C22C 38/06* (2013.01); *C23C 2/02* (2013.01); *C23C 2/0224* (2022.08); *C23C 2/026* (2022.08); *C23C 2/06* (2013.01); *C25D 3/30* (2013.01)

(58) Field of Classification Search

CPC . C21D 1/26; C21D 1/673; C21D 1/76; C21D 2211/001; C21D 2211/005; C21D 8/0273; C21D 8/0278; C21D 9/46; C22C 38/02; C22C 38/04; C22C 38/06; C23C 2/02; C23C 2/0224; C23C 2/026; C23C 2/06; C23C 2/12; C25D 3/30

See application file for complete search history.

(56) References Cited

U.S. PATENT DOCUMENTS

| | | | | |
|---|---|---|---|---|
| 5,827,618 | A | 10/1998 | Oyagi et al. | |
| 10,351,937 | B2 | 7/2019 | Kawata et al. | |
| 10,549,506 | B2 | 2/2020 | Kawamura et al. | |
| 11,674,209 | B2 * | 6/2023 | Bordignon | C21D 9/46 420/103 |
| 2006/0096674 | A1 | 5/2006 | Choquet et al. | |
| 2007/0163685 | A1 | 7/2007 | Kusumi | |
| 2018/0363117 | A1 | 12/2018 | Sohn et al. | |

FOREIGN PATENT DOCUMENTS

| | | | |
|---|---|---|---|
| CN | 107002207 | A | 8/2017 |
| CN | 107406988 | A | 11/2017 |
| EP | 1 767286 | A1 | 3/2007 |
| EP | 2631320 | | 8/2013 |
| EP | 3 231887 | A1 | 10/2017 |
| JP | S6473062 | A | 3/1989 |
| JP | H04293759 | A | 10/1992 |
| JP | H08269662 | A | 10/1996 |
| JP | 2000212712 | | 8/2000 |
| JP | 2000219949 | A | 8/2000 |
| JP | 2001200351 | A | 7/2001 |
| JP | 2010043296 | A | 2/2010 |
| JP | 2010255106 | A | 11/2010 |
| JP | 5320899 | B2 | 10/2013 |
| KR | 20140131203 | A | 11/2014 |
| KR | 20150049991 | A | 5/2015 |
| KR | 20170075046 | A | 7/2017 |
| RU | 2300579 | C2 | 6/2007 |
| RU | 2573154 | C2 | 1/2016 |
| WO | WO2014124749 | | 8/2014 |
| WO | WO 2017/111431 | A1 | 6/2017 |

OTHER PUBLICATIONS

International Search Report of PCT/IB2018/058185, Dec. 17, 2018.

(Continued)

*Primary Examiner* — Jie Yang

(74) *Attorney, Agent, or Firm* — Davidson Kappel LLC

(57) ABSTRACT

A hot-dip coated steel substrate coated with a layer of Sn directly topped by a zinc or an aluminum based coating is provided, the steel substrate having the following chemical composition in weight percent:

0.10≤C≤0.4%, 1.2≤Mn≤6.0%, 0.3≤Si≤2.5%,

Al<2.0%, and on a purely optional basis, one or more elements such as

P<0.1%, Nb

≤0.5%, B≤

0.005%,

Cr≤1.0%,

Mo≤0.50%,

Ni≤1.0%,

Ti≤0.5%, the remainder of the composition making up of iron and inevitable impurities resulting from the elaboration, the steel substrate further having between 0.0001 and 0.01% by weight of Sn in the region extending from the steel substrate surface up to 10 μm.

13 Claims, No Drawings

(56) References Cited

OTHER PUBLICATIONS

V. Merklinger et al., "Entwicklung einer niedrigschmelzenden Legierung und deren Applikation zum Korrosionsschutz hochfester Stähle", Materialwissenschaft Und Werkstofftechnik., De, (Dec. 1, 2008), vol. 39, No. 12, doi:10.1002/mawe.200800395, ISSN 0933-5137, pp. 888-891, see International Search Report of PCT/IB2018/058185, Dec. 17, 2018.

Salzgitter Flachstahl, "22MnB5", Salzgitter, doi:10.1016/j.surfcoat.2013.03.045, (Jan. 30, 2014), pp. 1-3, URL: https://www.salzgitter-Flachstahl.de/fileadmin/mediadb/szfg/informationsmaterial/produktinformationen/warmgewalzte_produkte/eng/22mnb5.pdf, (20180809).

Fan D W et al, "State-of-the-knowledge on coating systems for hot stamped parts", Steel Research Internatio, Verlag Stahleisen Gmbh., Dusseldorf, DE, vol. 83, No. 5, doi: 10.1002/SRIN.201100292, ISSN 1611-3683, (May 1, 2012), pp. 412-433, (Mar. 16, 2012.

M. Manna et al, "Improvement in galvanization and galvannealing characteristics of DP 590 steel by prior Cu or Cu—Sn flash coating", Surface and Coatings Technology, Amsterdam, NL, (Jul. 1, 2014), vol. 251, ISSN 0257-8972, pp. 29-37.

Artikel: M. Kodym et al.: "Spurenelemente im Stahl-Möglichkeiten zur Beeinflussung im Schmelzbetrieb"; Stahleisen-Berichte; Verlag Stahleisen mbH; ISBN 3-514-00324-6, 1985, see translation.

Artikel: L. Cho et al.: "Influence of Minor Alloying Elements on Selective Oxidation and Reactive Wetting of CMnSi TRIP Steel during Hot Dip Galvanizing"; Metallurgical and Materials Transactions A, vol. 45A, Sep. 2014, pp. 4484-4498.

Artikel: E.M. Bellhouse and J.R. McDermid: ‚Selective Oxidation and Reactive Wetting During Hot-Dip Galvanizing of a 1.0 PCT Al-0.5 PCT Si TRIP-Assisted Steel; Metallurgical and Materials Transactions A, vol. 43A, Jul. 2012, pp. 2426-2441.

* cited by examiner

HOT-DIP COATED STEEL SUBSTRATE

This is a continuation of U.S. patent application Ser. No. 16/769,912 filed on Jun. 4, 2020 which is a national phase of PCT/IB2018/058185, filed on Oct. 22, 2018 and claims priority to International Patent Application PCT/IB2017/058107, filed on Dec. 19, 2017. All of the above are hereby incorporated by reference herein.

The present invention relates to a hot-dip coated steel substrate and a method for the manufacture of this hot-dip coated steel substrate. The invention is particularly well suited for automotive industry.

BACKGROUND

With a view of saving the weight of vehicles, it is known to use high strength steels for the manufacture of automobile vehicle. For example for the manufacture of structural parts, mechanical properties of such steels have to be improved. It is known to add alloying elements to improve the mechanical properties of the steel. Thus, high strength steels or ultra-high strength steels including TRIP (Transformation-Induced Plasticity) steel, DP (Dual Phase) steels and HSLA (High-Strength Low Allowed) are produced and used, said steel sheets having high mechanical properties.

Usually, these steels are coated with a metallic coating improving properties such as corrosion resistance and phosphatability. The metallic coatings can be deposited by hot-dip coating after the annealing of the steel sheets. However, for these steels, during the annealing performed in a continuous annealing line, the alloying elements having higher affinity towards oxygen (compared to iron) such as Manganese (Mn), Aluminum (Al), Silicon (Si) or Chromium (Cr) oxidize and lead to the formation of layer of oxides at the surface. These oxides being for example manganese oxide (MnO) or silicon oxide ($SiO_2$) can be present in a form of a continuous film on the surface of the steel sheet or in the form of discontinuous nodules or small patches. They prevent the proper adherence of the metallic coating to be applied and can result in zones in which there is no coating on the final product or problems related to the delamination of the coating.

The patent application JP2000212712 discloses a method for the manufacture of a galvanized steel sheet comprising 0.02% by weight or more of P and/or 0.2% by weight or more of Mn, wherein the steel sheet is heated and annealed under non-oxidizing atmosphere and thereafter, dipped into a galvanizing bath containing Al to execute the galvanizing, a coating composed of one or more kinds selected among metallic compounds of Ni, Co, Sn and Cu base in the range of 1-200 $mg \cdot m^{-2}$ as an amount converted into the metallic quantity, is stuck on the surface of the steel sheet prior to annealing.

SUMMARY OF THE INVENTION

However, the steel sheets cited in the above patent application are low carbon steel sheets, also called conventional steel sheets, including IF steels, i.e. interstitial free steels, or BH steels, i.e. bake-hardening steels. Indeed, in the Examples, the steel sheets comprise very low amounts of C, Si, Al so the coating adheres on these steels. Additionally, only the pre-coatings comprising Ni, Co and Cu were tested.

Thus, there is a need to find a way to improve the wetting and the coating adhesion of high strength steels and ultra-high strength steels, i.e. steel substrate comprising a certain amount of alloying elements.

An object of the present invention is to provide a coated steel substrate having a chemical composition including alloying elements, wherein the wetting and the coating adhesion is highly improved. Another object is to provide an easy to implement method for the manufacture of said coated metallic substrate.

The present invention provides a hot-dip coated steel substrate coated with a layer of Sn directly topped by a zinc or an aluminum based coating, said steel substrate having the following chemical composition in weight percent:

$0.10 \leq C \leq 0.4\%$,
$1.2 \leq Mn \leq 6.0\%$,
$0.3 \leq Si \leq 2.5\%$,
$Al < 2.0\%$,
and on a purely optional basis, one or more elements such as
$P < 0.1\%$, Nb
$\leq 0.5\%$, $B \leq$
$0.005\%$,
$Cr \leq 1.0\%$,
$Mo \leq 0.50\%$,
$Ni \leq 1.0\%$,
$Ti \leq 0.5\%$, the remainder of the composition making up of iron and inevitable impurities resulting from the elaboration, said steel substrate further comprising between 0.0001 and 0.01% by weight of Sn in the region extending from the steel substrate surface up to 10 μm.

A method for the manufacture of the coated steel substrate and a use of the coated steel substrate are also provided.

DETAILED DESCRIPTION

Other characteristics and advantages of the invention will become apparent from the following detailed description of the invention.

The following term will be defined:

"wt. %" means the percentage by weight.

The invention relates to a hot-dip coated steel substrate coated with a layer of Sn directly topped by a zinc or an aluminum based coating, said steel substrate having the following chemical composition in weight percent:

$0.10 \leq C \leq 0.4\%$,
$1.2 \leq Mn \leq 6.0\%$,
$0.3 \leq Si \leq 2.5\%$,
$Al < 2.0\%$,
and on a purely optional basis, one or more elements such as P
$< 0.1\%$,
$nb \leq 0.5\%$, B
$\leq 0.005\%$,
$Cr \leq 1.0\%$,
$Mo \leq 0.50\%$,
$Ni \leq 1.0\%$,
$Ti \leq 0.5\%$, the remainder of the composition making up of iron and inevitable impurities resulting from the elaboration, said steel substrate further comprising between 0.0001 and 0.01% by weight of Sn in the region extending from the steel substrate surface up to 10 μm.

Without willing to be bound by any theory, it seems that the specific steel substrate has a greatly modified surface specially during the recrystallization annealing. In particular, it is believed that Sn segregates in region within 10 μm in a surface layer of the steel substrate by a Gibbs mechanism reducing the surface tension of the steel substrate. Moreover, a thin monolayer of Sn is still present on the steel substrate. Thus, it seems that selective oxides are present in a form of nodules at the steel substrate surface instead of a continuous layer of selective oxides allowing high wettability and high coating adhesion.

Regarding the chemical composition of the steel, the carbon amount is between 0.10 and 0.4% by weight. If the carbon content is below 0.10%, there is a risk that the tensile strength is insufficient, for example lower than 900 MPa. Furthermore, if the steel microstructure contains retained austenite, its stability which is necessary for achieving sufficient elongation, can be not obtained. Above 0.4% C, weldability is reduced because low toughness microstructures are created in the Heat Affected Zone or in the molten zone of the spot weld. In a preferred embodiment, the carbon content is in the range between 0.15 and 0.4% and more preferably between 0.18 and 0.4%, which makes it possible to achieve a tensile strength higher than 1180 MPa.

Manganese is a solid solution hardening element which contributes to obtain high tensile strength, for example higher than 900 MPa. Such effect is obtained when Mn content is at least 1.2% in weight. However, above 6.0%, Mn addition can contribute to the formation of a structure with excessively marked segregated zones which can adversely affect the welds mechanical properties. Preferably, the manganese content is in the range between 2.0 and 5.1% and more preferably 2.0 and 3.0% to achieve these effects.

Silicon must be comprised between 0.3 and 2.5%, preferably between 0.5 and 1.1 or 1.1 to 3.0%, more preferably between 1.1 to 2.5% and advantageously between 1.1 to 2.0% by weight of Si to achieve the requested combination of mechanical properties and weldability: silicon reduces the carbides precipitation during the annealing after cold rolling of the sheet, due to its low solubility in cementite and due to the fact that this element increases the activity of carbon in austenite.

Aluminum must be below or equal to 2.0%, preferably above or equal to 0.5% and more preferably above or equal to 0.6%. With respect to the stabilization of retained austenite, aluminum has an influence that is relatively similar to the one of the silicon. Preferably, when the amount of Al is above or equal to 1.0%, the amount of Mn is above or equal to 3.0%.

The steels may optionally contain elements such as P, Nb, B, Cr, Mo, Ni and Ti, achieving precipitation hardening.

P is considered as a residual element resulting from the steelmaking. It can be present in an amount <0.1% by weight.

Titanium and Niobium are also elements that may optionally be used to achieve hardening and strengthening by forming precipitates. However, when the Nb or Ti content is greater than 0.50%, there is a risk that an excessive precipitation may cause a reduction in toughness, which has to be avoided. Preferably, the amount of Ti is between 0.040% and 0.50% by weight or between 0.030% and 0.130% by weight. Preferably, the titanium content is between 0.060% and 0.40% and for example between 0.060% and 0.110% by weight. Preferably, the amount of Nb is between 0.070% and 0.50% by weight or 0.040 and 0.220%. Preferably, the niobium content is between 0.090% and 0.40% and advantageously between 0.090% and 0.20% by weight.

The steels may also optionally contain boron in quantity comprised below or equal to 0.005%. By segregating at the grain boundary, B decreases the grain boundary energy and is thus beneficial for increasing the resistance to liquid metal embrittlement.

Chromium makes it possible to delay the formation of pro-eutectoid ferrite during the cooling step after holding at the maximal temperature during the annealing cycle, making it possible to achieve higher strength level. Thus, the chromium content is below or equal to 1.0% for reasons of cost and for preventing excessive hardening.

Molybdenum in quantity below or equal to 0.5% is efficient for increasing the hardenability and stabilizing the retained austenite since this element delays the decomposition of austenite.

The steels may optionally contain Nickel, in quantity below or equal to 1.0% so to improve the toughness.

Preferably, the steel substrate comprises below 0.005% and advantageously below 0.001% by weight of Sn in a region extending from the steel substrate surface up to 10 μm.

Preferably, the layer of Sn has a coating weight between 0.3 and 200 $mg \cdot m^{-2}$, more preferably between 0.3 and 150 $mg \cdot m^{-2}$, advantageously between 0.3 and 100 $mg \cdot m^{-2}$ and for example between 0.3 and 50 $mg \cdot m^{-2}$.

Preferably, the steel substrate microstructure comprises ferrite, residual austenite and optionally martensite and/or bainite.

Preferably, the tensile stress of the steel substrate is between above 500 MPa, preferably between 500 and 2000 MPa. Advantageously, the elongation is above 5% and preferably between 5 and 50%.

In a preferred embodiment, the aluminum-based coating comprises less than 15% Si, less than 5.0% Fe, optionally 0.1 to 8.0% Mg and optionally 0.1 to 30.0% Zn, the remainder being Al.

In another preferred embodiment, the zinc-based coating comprises 0.01-8.0% Al, optionally 0.2-8.0% Mg, the remainder being Zn. More preferably, the zinc-based coating comprises between 0.15 and 0.40% by weight of Al, the balance being Zn.

The molten bath can also comprise unavoidable impurities and residuals elements from feeding ingots or from the passage of the steel substrate in the molten bath. For example, the optionally impurities are chosen from Sr, Sb, Pb, Ti, Ca, Mn, Sn, La, Ce, Cr, Zr or Bi, the content by weight of each additional element being inferior to 0.3% by weight. The residual elements from feeding ingots or from the passage of the steel substrate in the molten bath can be iron with a content up to 5.0%, preferably 3.0%, by weight.

The present invention also relates to a method for the manufacture of a hot-dip coated steel substrate comprising a heating section, a soaking section, a cooling section, optionally an equalizing section, such method comprising the following steps:

A. The provision of a steel substrate having the chemical composition according to the present invention,
B. the deposition of a coating consisting of Sn,
C. the recrystallization annealing of the pre-coated steel substrate obtained in step B) comprising the subfollowing steps:
   i. the heating of the pre-coated steel substrate in the heating section having an atmosphere Al comprising less than 8% by volume of H2 and at least one inert gas which a dew point DP1 is below or equal to −45° C.,
   ii. the soaking of the steel substrate in the soaking section having an atmosphere A2 comprising less than 30% by volume of H2 and at least one inert gas which a dew point DP2 is below or equal to −45° C.,
   iii. the cooling of the steel substrate in the cooling section,
   iv. optionally, the equalizing of the steel substrate in the equalizing section and D. The hot-dip coating with a zinc or an aluminum based coating.

Without willing to be bound by any theory, it is believed that if the atmosphere comprising above 8 vol. % of 2 and/or DP is above −45° C., it seems that water is formed during the recrystallization annealing due to the reduction of the thin monolayer of Sn. It is believed that water reacts with the iron of the steel to form iron oxide covering the steel substrate. Thus, there is a risk not to control the selective oxidation and therefore that selective oxides are present in a form of continuous layer on the steel substrate decreasing significantly the wettability.

Preferably, in step B), the coating consisting of Sn is deposited by electroplating, electroless plating, cementation, roll coat or vacuum deposition. Preferably, the Sn coating is deposited by electrodeposition.

Preferably, in step B), the coating consisting of Sn has a coating weight between 0.6 and 300 $mg \cdot m^{-2}$, preferably between 6 and 180 $mg \cdot m^{-2}$ and more preferably between 6 and 150 $mg \cdot m^{-2}$. For example, the coating consisting of Sn has a coating weight of 120 $mg \cdot m^{-2}$ and more preferably of 30 $mg \cdot m^{-2}$.

Preferably, in step C.i), the pre-coated steel substrate is heated from ambient temperature to a temperature T1 between 700 and 900° C.

Advantageously, in step C.i), the soaking is performed in an atmosphere comprising an inert gas and $H_2$ in an amount below or equal to 7%, more preferably below 3% by volume, advantageously below or equal to 1% by volume and more preferably below or equal to 0.1%.

In a preferred embodiment, the heating comprises a pre-heating section.

Preferably, in step C.ii), the pre-coated steel substrate is soaked at a temperature T2 between 700 and 900° C.

For example, in step C.ii), the amount of H2 is below or equal to 20% by volume, more preferably below or equal 10% by volume and advantageously below or equal 3% by volume.

Advantageously, in steps Ci) and C.ii), DP1 and DP2 are independently from each other are below or equal to −50° C. and more preferably are below or equal to −60° C. For example, DP1 and DP2 can be equal or different.

Preferably in step C.iii), the pre-coated steel substrate is cooled from T2 to a temperature T3 between 400 and 500° C., T3 being the bath temperature.

Advantageously, the cooling is performed in an atmosphere A3 comprising from less than 30% H2 by volume and an inert gas whose a dew point DP3 is below or equal to −30° C.

Optionally, the equalizing of the steel substrate from a temperature T3 to a temperature T4 between 400 and 700° C. in the equalizing section having an atmosphere A4 comprising less than 30% H2 by volume and an inert gas whose a dew point DP4 is below or equal to −30° C.

Preferably, in all the steps step C.i) to C.iv), the at least one inert gas is chosen from among: nitrogen, argon and helium. For example, the recrystallization annealing is performed in a furnace comprising a direct flame furnace (DFF) and a radiant tube furnace (RTF), or in a full RTF. In a preferred embodiment, the recrystallization annealing is performed in a full RTF.

Finally, the present invention relates to the use of a hot-dip coated steel substrate according to the present invention for the manufacture of a part of an automotive vehicle.

The invention will now be explained in trials carried out for information only. They are not limiting.

EXAMPLES

The following steel sheets having the following composition were used:

| steel sheet | C (wt. %) | Si(wt. %) | Mn(wt. %) | Cr(wt. %) | Al(wt. %) |
|---|---|---|---|---|---|
| 1* | 0.151 | 1.33 | 2.27 | 0.21 | 0.08 |
| 2* | 0.20 | 2.2 | 2.2 | — | 0.5 |
| 3* | 0.12 | 0.5 | 5 | — | 1.8 |
| 4 | 0.104 | 0.10 | 1.364 | 0.46 | 1.26 |
| 5 | 0.6 | 0.25 | 23 | — | 0.1 |
| 6 | 0.7 | 0.05 | 18 | — | 2 |

*according to the present invention.

Some Trials were coated with Tin (Sn) deposited by electroplating. Then, all the Trials were annealed in a full RTF furnace at a temperature of 800° C. in an atmosphere comprising nitrogen and optionally hydrogen during 1 minute. Then, Trials were hot-dip galvanized with zinc coating.

The wetting was analyzed by naked eyes and optical microscope. 0 means that the coating is continuously deposited; 1 means that the coating adheres well on the steel sheet even if very few bare spots are observed; 2 means that many bare sports are observed and 3 means that large uncoated areas are observed in the coating or no coating was present on the steel.

Finally, the coating adhesion was analyzed by bending the sample to an angle of 135° for Steels 1 and 4, an angle of 90° for Steel 6 and an angle of 180° C. For Trial 5. An adhesive tape was then applied on the samples before being removed to determine if the coating was taken off. 0 means that the coating has not been taken off, i.e. no coating is present on the adhesive tape, 1 means that some parts of the coating have been taken off, i.e. parts of the coating are present on the adhesive tape and 2 means that the entire or almost the entire coating is present on the adhesive tape. When the wetting was of 3, if no coating was present on the steel, the coating adhesion was not performed.

The results are in the following table:

| | | Sn pre-coating | Annealing | | Hot-dip | | Coating |
|---|---|---|---|---|---|---|---|
| Trials | Steel | ($mg/m^2$) | gases | DP (° C.) | coating | Wetting | adhesion |
| 1 | 1 | 0 | 5% $H_2/N_2$ | −60 | zinc | 3 | ND |
| 2 | 4 | 0 | 5% $H_2/N_2$ | −60 | zinc | 3 | ND |
| 3* | 1 | 35 | $N_2$ | −60 | zinc | 0 | 0 |
| 4 | 4 | 35 | $N_2$ | −60 | zinc | 1 | 2 |
| 5 | 1 | 35 | 5% $H_2/N_2$ | −30 | zinc | 3 | ND |
| 6 | 1 | 35 | 5% $H_2/N_2$ | −40 | zinc | 3 | ND |
| 7* | 1 | 35 | 5% $H_2/N_2$ | −50 | zinc | 0 | 0 |
| 8 | 4 | 35 | 5% $H_2/N_2$ | −50 | zinc | 2 | 1 |

-continued

| Trials | Steel | Sn pre-coating ($mg/m^2$) | Annealing gases | Annealing DP (° C.) | Hot-dip coating | Wetting | Coating adhesion |
|---|---|---|---|---|---|---|---|
| 9* | 1 | 35 | 5% $H_2/N_2$ | −60 | zinc | 0 | 0 |
| 10 | 4 | 35 | 5% $H_2/N_2$ | −60 | zinc | 1 | 2 |
| 11 | 5 | 150 | 5% $H_2/N_2$ | −65 | zinc | 3 | ND |
| 11 | 6 | 150 | 5% $H_2/N_2$ | −65 | zinc | 3 | ND |
| 12* | 2 | 150 | 5% $H_2/N_2$ | −65 | zinc | 1 | 0 |
| 13* | 3 | 150 | 5% $H_2/N_2$ | −65 | zinc | 1 | 0 |
| 14* | 1 | 150 | 5% $H_2/N_2$ | −60 | zinc | 0 | 0 |
| 15* | 2 | 150 | 5% $H_2/N_2$ | −60 | zinc | 1 | 0 |
| 16* | 3 | 150 | 5% $H_2/N_2$ | −60 | zinc | 1 | 0 |
| 17 | 4 | 150 | 5% $H_2/N_2$ | −60 | zinc | 1 | 2 |
| 18 | 5 | 150 | 5% $H_2/N_2$ | −60 | zinc | 3 | ND |
| 19 | 6 | 150 | 5% $H_2/N_2$ | −60 | zinc | 3 | ND |

*according to the present invention.
ND: not done.

All the Trials according to the present invention show a high wetting and a high coating adhesion.

What is claimed is:

1. A hot-dip coated metallic steel substrate comprising:

a steel substrate surface coated with a layer of Sn directly topped by a zinc or aluminum based coating, the steel substrate having the following chemical composition in weight percent:

0.10≤C≤0.4%,
1.2≤Mn≤6.0%,
0.3≤Si≤2.5%,
Al≤2.0%, and on a purely optional basis, at least one of the following elements:

P<0.1%,
nb≤0.5%,
B≤0.005%,
Cr≤1.0%,
Mo≤0.50%,
Ni≤1.0%,
Ti≤0.5%, a remainder of the composition making up of iron and inevitable impurities resulting from processing, the steel substrate further comprising between 0.0001 and 0.005% by weight of Sn in a region extending from the steel substrate surface up to 10 μm.

2. The coated metallic substrate as recited in claim 1 wherein when the amount of Al in the steel substrate is 1.0% ≤Al≤2.0%, weight, and the amount of Mn in the steel substrate is 3.0 ≤Mn≤6.0%, by weight.

3. The coated metallic substrate as recited in claim 1 wherein the thin layer of Sn has a coating weight between 0.3 and 200 $mg.m^{-2}$.

4. The coated metallic substrate as recited in claim 3 wherein the thin layer of Sn has a coating weight between 0.3 and 150 mg.m−2.

5. The coated metallic substrate as recited in claim 1 wherein the zinc or aluminum based coating is a zinc-based coating including from 0.01 to 8.0% by weight of Al, optionally from 0.2 to 8.0% by weight of Mg, a remainder being Zn.

6. The coated metallic substrate as recited in claim 5 wherein the zinc-based coating includes between 0.15 and 0.40% by weight of Al, the balance being Zn.

7. The coated metallic substrate as recited in claim 1 wherein the zinc or aluminum based coating is an aluminum-based coating.

8. The coated metallic substrate as recited in claim 1 wherein the steel substrate includes between 1.1 and 2.5% by weight of Si.

9. The coated metallic substrate as recited in claim 1 wherein the steel substrate includes between 0.5 and 1.1% by weight of Si.

10. The coated metallic substrate as recited in claim 1 wherein the steel substrate comprises 0.5% ≤Al≤2.0%, by weight.

11. The coated metallic substrate as recited in claim 10 wherein the steel substrate comprises 0.6% ≤Al≤2.0%, by weight of Al.

12. The coated metallic substrate as recited in claim 1 wherein a microstructure of the steel substrate includes ferrite, residual austenite and optionally martensite or bainite.

13. An automotive vehicle part comprising the coated metallic substrate as recited in claim 1.

* * * * *